US005655777A

United States Patent [19]

Neading et al.

[11] Patent Number: 5,655,777

[45] Date of Patent: Aug. 12, 1997

[54] WEIGHTED RADIALLY-ARMED FLEXIBLE AND SPINNABLE THROWING OBJECT

[76] Inventors: Ryan R. Neading, 8740 W. 38th Ave., Wheatridge, Colo. 80033; Scott Boger, 1601 Capistrano Ave., Glendale, Calif. 91208

[21] Appl. No.: 665,232

[22] Filed: Jun. 17, 1996

Related U.S. Application Data

[60] Provisional application No. 60/008,075, Oct. 30, 1995.

[51] Int. Cl. [6] ..... A63B 65/00

[52] U.S. Cl. ..... 473/594

[58] Field of Search ..... 273/424, 425, 273/426, 427, 428

[56] References Cited

U.S. PATENT DOCUMENTS

| | | | |
|---|---|---|---|
| 442,675 | 12/1890 | Wilcox | 273/428 |
| 2,002,631 | 5/1935 | Flondella | 273/428 |
| 2,187,493 | 1/1940 | Gordon | 273/427 |
| 2,408,160 | 9/1946 | Brunner | 273/428 |
| 4,115,946 | 9/1978 | Vukmirovich | 273/428 |
| 4,222,573 | 9/1980 | Adler | 273/426 |
| 4,284,278 | 8/1981 | Bradford | 273/426 |
| 5,112,061 | 5/1992 | Lamle | 273/428 X |
| 5,180,171 | 1/1993 | Panzica et al. | 273/428 |
| 5,294,129 | 3/1994 | Brown | 273/327 |
| 5,310,194 | 5/1994 | Scheel | 273/428 X |
| 5,326,299 | 7/1994 | Jasinski | 446/46 |
| 5,358,440 | 10/1994 | Zheng | 446/48 |
| 5,375,848 | 12/1994 | Coleman | 273/327 |

FOREIGN PATENT DOCUMENTS

| | | | |
|---|---|---|---|
| 448840 | 4/1968 | Switzerland | 273/428 |

*Primary Examiner*—William H. Grieb
*Attorney, Agent, or Firm*—John R. Flanagan

[57] ABSTRACT

A weighted radially-armed flexible and spinnable throw game device includes a central core defining an inner pocket filled with a centrally-located inner mass of weighted material and a plurality of spaced apart arms extending radially outward from the central core. The arms may number three, four, five or any other suitable number and each has a pair of opposite outer and inner end portions. The inner end portion is integral with the central core. The outer end portion of each arm defines an outer pocket filled with a peripherally-located outer mass of weighted material. Thus, the outer masses of weighted material in the outer pockets of the elongated arms being circumferentially spaced from one another and radially spaced from the inner mass of weighted material in the inner pocket of the central core together with the inner mass of weighted material creates a generally planar stable balanced spinning device when the throwing object is launched or thrown into flight.

21 Claims, 1 Drawing Sheet

WEIGHTED RADIALLY-ARMED FLEXIBLE AND SPINNABLE THROWING OBJECT

This application claims the benefit of U.S. provisional application No. 60/008,075, filed Oct. 30, 1995.

BACKGROUND OF THE INVENTION

1. Field of the Invention

The present invention generally relates to throwing games and, more particularly, is concerned with a weighted radially-armed flexible and spinnable throwing object.

2. Description of the Prior Art

Games and activities employing throwing objects have been a popular form of recreation for many years now. Perhaps the most familiar throwing device is the flying disc identified by the trademark "Frisbee," which is manufactured by Wham-O Manufacturing Company of San Gabriel, Calif., and disclosed in U.S. Pat. No. 3,359,678 to Headrick. The "Frisbee" disc is generally comprised of a substantially rigid plastic material and has a recessed undersurface which curves down into an outer rim of the disc. The "Frisbee" disc is intended to be thrown by a user flicking the wrist of his or her hand and thereby causing the disc to rotate in an aerodynamically stable manner to achieve long distance flights.

Other game devices have been developed over the years which are intended to be thrown in a similar fashion and to thereby achieve a like form and length of flight. Representative examples of these throwing devices are disclosed in U.S. Pat. No. 4,115,946 to Vukmirovich, U.S. Pat. No. 5,180,171 to Panzica et al., U.S. Pat. No. 5,326,299 to Jasinski and U.S. Pat. No. 5,358,440 to Zheng. Still other game devices intended to be thrown using a hand-held instrument or a player's hand are disclosed in U.S. Pat. No. 442,675 to Wilcox, U.S. Pat. No. 2,002,631 to Fiondella, U.S. Pat. No. 5,294,129 to Brown and U.S. Pat. No. 5,375,848 to Coleman. Yet another game device intended to be impelled through the air by a kicking motion is disclosed in U.S. Pat. No. 2,408,160 to Brunner. While these prior art game devices appear to be satisfactory in use for the specific purposes for which they were designed, none of them seem to be generally adaptable for a variety of recreational uses nor allow users to experiment and to devise their own games and activities with the device.

Consequently, a need remains for a throwing device which overcomes the aforementioned need in the prior art devices and does so without creating any new problems in place thereof.

SUMMARY OF THE INVENTION

The present invention provides a weighted radially-armed flexible and spinnable throwing object designed to satisfy the aforementioned need. The throwing object of the present invention combines seemingly inconsistent attributes of a sack type kicking game device and a flying disc throwing game device to provide a device generally adaptable for a variety of recreational uses and challenges a user to devise his or her own games and activities with .the device. Also, the throwing object of the present invention is relatively simple to manufacture yet is capable of many uses.

Accordingly, the present invention is directed to a weighted radially-armed flexible and spinnable throwing object which comprises: (a) a central core having a mass of weighted material; and (b) a plurality of spaced apart elongated arms extending radially outward from the central core, each elongated arm having a pair of opposite outer and inner end portions, each outer end portion of the arm supporting another mass of weighted material spaced from the weighted material mass of the central core. The inner end portion of a respective arm is connected with and extends radially outwardly from a portion of a periphery of the central core. The outer end portion is connected to and extends outwardly from the inner end portion of the respective arm.

More particularly, the central core defines an inner pocket and the outer end portion of each arm defines an outer pocket. Each of the pockets contains one of the masses of weighted material. The masses of weighted material in the inner and outer pockets together create a generally planar stable balanced spinning object when the object is launched or thrown sidewise into flight. The weighted material may be comprised of any one or any combination of a variety of materials, for example a solid material such as foam, a granular material such as rice, beans, sand, or the like.

More particularly, central core of the throwing object is comprised of a flexible material such as a suitable fabric. The inner pocket containing the weighted material, as an example, is generally oblong in cross-sectional shape when viewed from a side of the central core. Preferably, the central core is formed by a pair of layers of the substantially inelastic flexible material. The weighted material in the inner pocket of the central core is confined between the two layers of inelastic flexible material by a continuous attachment line made therein which attaches the two layers together to form the periphery of the inner pocket.

The radial arms of the throwing object also are comprised of a flexible material and are spaced an equal distance apart from one another about the central core. The arms may number three, four, five or any other suitable number. Each outer pocket containing the weighted material, as an example, is substantially teardrop in cross-sectional shape when viewed from a side of the arm. Also, preferably each of the elongated arms is formed by a pair of layers of inelastic flexible material such as a suitable fabric. The weighted material in the outer pocket of each arm is confined between the two layers of flexible material by a continuous attachment of the peripheral edges of the two layers together at the outer end portion of the arm and by a transverse attachment line made in the two layers extending between opposite sides of the arm and separating the inner end portion of the arm from the outer end portion thereof. The continuous attachment of the peripheral edges of the two layers together and the transverse attachment line in the two layers combine with one another to form the periphery of outer pocket.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
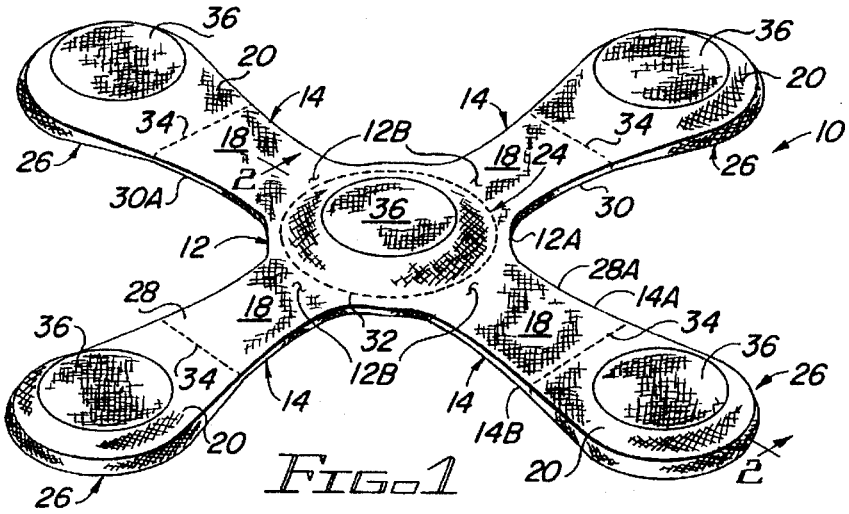
FIG. 1 is a top perspective view of a weighted radially-armed flexible and spinnable throwing object of the present invention, showing one embodiment of the throwing object having four arms.
Figure 2:
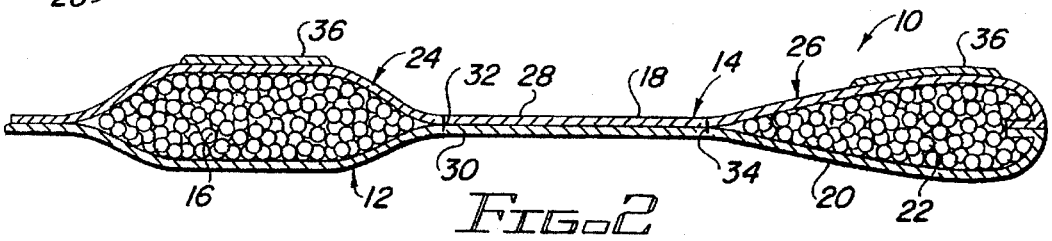
FIG. 2 is a cross-sectional view of the throwing object taken along line 2—2 of FIG. 1.

Referring to the drawings and particularly to FIGS. 1 and 2, there is illustrated a weighted radially-armed flexible and spinnable throwing object, generally designated 10, of the present invention. Basically, the throwing object 10 includes a central core 12 having a periphery 12A and a plurality of spaced apart radial extensions from the core 12 in the form of elongated arms 14 extending radially outward from the periphery 12A of the central core 12. The central core 12 has a centrally-located inner mass 16 of weighted material. Each elongated arm 14 has a pair of opposite inner and outer end portions 18, 20, with each outer end portion 20 supporting a peripherally-located outer mass 22 of weighted material spaced from the central or inner mass 16 of weighted material of the central core 12. The inner end portion 18 of each arm 14 is connected with and extends radially outwardly from a portion 12B of the periphery 12A of the central core 12.

Preferably, the central core 12 defines an inner pocket 24 while the outer end portions 20 of the arms 14 define outer pockets 26 in the throwing object 10. The inner pocket 24 defines an empty space which contains or is substantially filled by the inner mass 16 of weighted material while the outer enclosed pockets 26 define empty spaces which contain or are substantially filled by the outer masses 22 of weighted material. The inner pocket 24 defined by the central core 12 and the outer pockets 26 defined by the outer end portions 20 of the arms 14 can but not necessarily have substantially the same size. When viewed from the side as seen in FIG. 2, the inner pocket 24 filled with the central or inner mass 16 of weighted material is generally oblong shape in cross-section while each outer pocket 26 filled with the peripheral or outer mass 22 of weighted material is generally of teardrop shape in cross-section.

The masses 16, 22 of weighted material used to fill the inner and outer pockets 24, 26 are preferably but not necessarily substantially equal in size and weight. The masses 16, 22 of weighted material in the inner and outer pockets 24, 26 together create a generally planar stable balanced spinning device or object when the object 10 is launched or thrown sideways into flight. The weighted material may be comprised of any one or any combination of a variety of material, for example, a solid material such as foam, a granular material such as rice, beans, sand or the like. The weighted material in each inner and outer pocket 24, 26 may be the same or different as that found in any of the other pockets.

Figure 3:
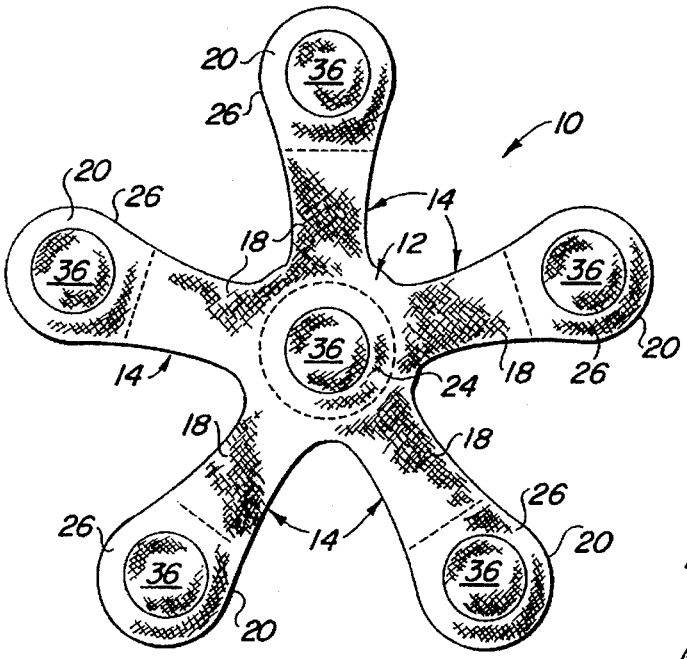
FIG. 3 is a top plan view of another embodiment of the throwing object having five arms.
Figure 4:
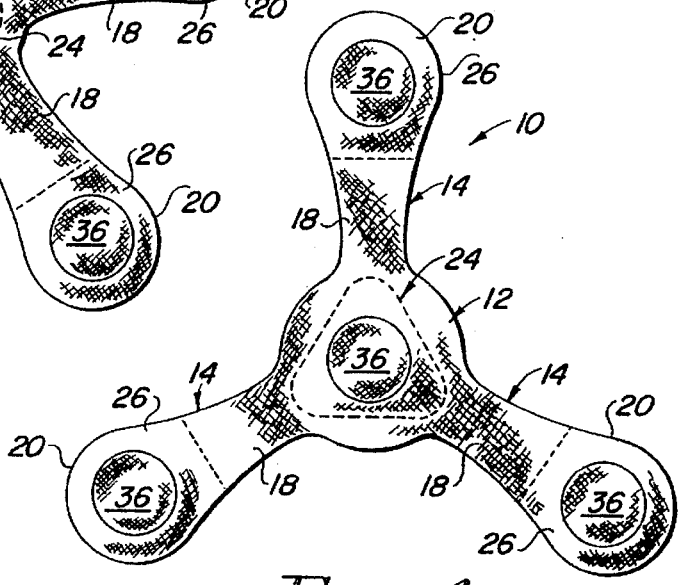
FIG. 4 is a top plan view of yet another embodiment of the throwing object having three arms.

Referring to FIGS. 1, 3 and 4, the elongated arms 14 of the throwing object 10 are preferably spaced a substantially equal distance apart from one another about the central core 12. When viewed from above and below the throwing object 10, the outer end portions 20 of the arms 14 are substantially wider in size than each of the inner end portions 18. Also, the outer end portions 20 of the arms 14 are substantially rounded in shape whereas the inner end portions 18 of the arms 14 are more or less hourglass in shape. As shown in FIGS. 1, 3 and 4, the arms 14 may number three, four, five or any other suitable number greater than one.

More particularly, the central core 12 and the arms 14 of the throwing object 10 are comprised of a flexible material, preferably although not necessary, a pair of layers 28, 30 of a substantially inelastic flexible material, for example a suitable fabric, such that the inner end portions 18 of the arms 14 are integrally connected to the central core 12 and the outer end portions 20 of the arms 14 are integrally connected to the inner end portions thereof. The inner mass 16 of weighted material in the inner enclosed pocket 24 of the central core 12 is confined between the top and bottom layers 28, 30 of inelastic flexible material of the throwing object 10 by a continuous attachment line 32 made therein, such as suitably formed by conventional stitching or application of a conventional adhesive material, which attaches the two layers 28, 30 together to form the periphery of the inner enclosed pocket 24. The outer masses 22 of weighted material in the outer pockets 26 of the arm 14 are confined between the top and bottom layers 28, 30 of inelastic flexible material by the continuous attachment of the peripheral edges 28A, 30A of the layers 28, 30 together at the outer end portions 20 of the arms 14 and by transverse attachment lines 34 made in the two layers extending between opposite sides 14A of the arms 14 and separating the inner end portion 18 of the arms 14 from the outer end portions 20 thereof. The continuous attachment of the peripheral edges 28A, 30A of the layers 28, 30 together and the transverse attachment line 32 in the layers 28, 30 combine with one another to form the periphery of outer enclosed pocket 26. The continuous attachment of the peripheral edges 28A, 30A of, and the formation of the transverse attachment line 34 in, the two layers 28, 30 of inelastic flexible material can be made by any suitable means, such as by stitching or applying an adhesive thereto.

In making the embodiment of the throwing object 10 showing in FIGS. 1–4, only conventional fabric material cutting and stitching techniques are employed. By way of example, the sequence for making the throwing object 10 can be as follows. First, the two layers 28, 30 are cut into the desired pattern of the throwing object 10 and then sewn together almost entirely around their peripheries, leaving only a small side or peripheral opening through which to supply the masses of weighted material to the pockets. Next, the outer end portions 20 of the arms 14 are supplied through the small peripheral opening with the outer masses 22 of weighted material and thereafter the transverse attachment lines 34 are completed to enclose the outer pockets 26 filled with the outer masses 22. The inner pocket 24 which previously has been almost completely stitched about its periphery is now supplied through the small peripheral opening with the inner mass 16 of weighted material. Finally, the stitching around the inner pocket 24 is completed as is the stitching along the small peripheral opening.

In addition, for decorative purposes and the like, circular patches 36 are applied on the top layer 28 overlying the inner pocket 24 of the central core 12 and the outer pockets 26 of the arms 14. Each circular patch 36 has a size less than that of the respective inner and outer pockets 24, 26.

The masses 22 of weighted material being provided in the outer enclosed pockets 26 of the arms 14 provide a means for a player to use to grip, throw, kick or catch the object 10. When a player takes hold of one of the arms 14 filled with the outer mass 22 of weighted material 16 and tosses the object 10 using a side-arm throw, the object 10 rotates and creates a centrifugal force which causes the arms 14 to fully extend radially outward from the central core 12 and to thereby create a planar stable spinning object while in flight.

While the present invention is heretofore referred to as a "throwing object", it should also be understood that because of its flexibility, the substantially symmetrical distribution of its peripheral or outer masses 22 of weighted material about the central or inner mass 16 of weighted material, and the weighted material of the masses 16, 22, the object 10 can be played with by being kicked as well.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A weighted radially-armed flexible and spinnable throwing object, comprising:

(a) a central core having a periphery and a mass of weighted material; and (b) a plurality of spaced apart elongated arms extending radially outward from the central core, each of said arms having a pair of opposite inner and outer end portions, said inner end portion of each of said arms being connected with and extending radially outwardly from a portion of said periphery of said central core, said outer end portion of each of said arms being connected to and extends outwardly from said inner end portion thereof and supporting another mass of weighted material, said masses of weighted material in said respective outer end portions of said arms being spaced circumferentially from one another and spaced radially outwardly from said mass of weighted material in said central core such that a generally planar stable balanced spinning device is created when said throwing object is launched into flight;

(c) said elongated arms and said central core being made of a flexible material such that said inner end portion of each of said arms is integrally connected to said central core and said outer end portion of each of said arms is integrally connected to said inner end portion thereof.

2. The object of claim 1 wherein said arms are three in number.

3. The object of claim 1 wherein said arms are four in number.

4. The object of claim 1 wherein said arms are five in number.

5. The object of claim 1 wherein each of said masses of weighted material are substantially equal in weight.

6. The object of claim 1 wherein said arms are spaced a substantially equal distance apart from one another about said central core.

7. A weighted radially-armed flexible and spinnable throwing object, comprising:

(a) a central core made of a flexible material and defining an inner pocket;

(b) a mass of weighted material filling said inner pocket of said central core;

(c) a plurality of spaced apart elongated arms made of a flexible material and extending radially outward from said central core, each said arm having a pair of opposite inner and outer end portions, said inner end portion being connected with and extending radially outwardly from a portion of a periphery of said central core, said outer end portion connected to and extending outwardly from said inner end portion and defining an outer pocket; and (d) a plurality of masses of weighted material in said respective outer pockets of said outer end portions of said elongated arms being circumferentially spaced from one another and radially spaced from said mass of weighted material in said inner pocket of said central core, said masses of weighted material in said inner and outer pockets together creating a generally planar stable balanced spinning device when said throwing object is launched into flight.

8. The object of claim 7 wherein said arms are three in number.

9. The object of claim 7 wherein said arms are four in number.

10. The object of claim 7 wherein said arms are five in number.

11. The object of claim 7 wherein said arms are spaced a substantially equal distance apart from one another about said central core.

12. The object of claim 7 wherein each of said outer end portions of said arms is substantially wider in size than each of said inner end portions shape when viewed from above and below said throwing object.

13. The object of claim 7 wherein each of said outer end portions of said arms is substantially rounded in shape when viewed from above and below said throwing object.

14. The object of claim 7 wherein said inner pocket defined by said central core and said outer pockets defined by said outer end portions of said arms have substantially the same size.

15. The object of claim 7 wherein said weighted material used to fill said inner pocket defined by said central core and said outer pockets defined by said second end portions of said arms is comprised of a multiplicity of granules.

16. The object of claim 7 wherein said central core is formed by a pair of layers of a substantially inelastic flexible material.

17. The object of claim 16 wherein said mass of weighted material in said inner pocket of said central core is confined between said layers by a continuous attachment line made therein which attaches said layers together to form a periphery of said inner pocket.

18. The object of claim 16 wherein each of said elongated arms is formed by a pair of layers of inelastic flexible material.

19. The object of claim 18 wherein said mass of weighted material in said outer pocket of each of said arms is confined between said layers by a continuous attachment of peripheral edges of said layers together at said outer end portion of each of said arms and by a transverse attachment line made in said layers extending between opposite sides of each of said arms and separating said inner end portion from said outer end portion of each of said arms, said continuous attachment of said peripheral edges of said layers together and said transverse attachment line in said layers combine with one another to form a periphery of said outer pocket.

20. The object of claim 7 wherein said central core and said elongated arms are formed by a pair of layers of a substantially inelastic flexible material such that said inner end portion of each of said arms is integrally connected to said central core and said outer end portion of each of said arms is integrally connected to said inner end portion thereof.

21. The object of claim 7 wherein said inner pocket defined by said central core and said outer pockets defined by said second end portions of said arms each has a circular patch applied on a top surface thereof, each said circular patch having a size less than that of said respective inner and outer pockets.

* * * * *